US005311619A

United States Patent [19]

Ward

[11] Patent Number: 5,311,619

[45] Date of Patent: May 17, 1994

[54] DEVICE FOR OPENING AND CLOSING TOILET SEAT

[76] Inventor: Keith J. Ward, 3351 E. 4th St., Tulsa, Okla. 74110

[21] Appl. No.: 808,667

[22] Filed: Dec. 17, 1991

[51] Int. Cl.[5] ..... A47K 13/10

[52] U.S. Cl. ..... 4/246.1

[58] Field of Search ..... 4/246.1-246.5, 4/248

[56] References Cited

U.S. PATENT DOCUMENTS

| | | | |
|---|---|---|---|
| 1,654,520 | 12/1927 | Frohlich | 4/246.5 |
| 2,117,663 | 5/1938 | Hill | 4/246.3 |
| 2,219,044 | 10/1940 | Horr | 4/246.1 X |
| 3,284,810 | 11/1966 | Stokes | 4/246.1 |
| 4,807,307 | 2/1989 | Sato et al. | 4/246.4 |
| 4,912,783 | 4/1990 | Shafer | 4/246.1 |
| 4,995,120 | 2/1991 | Tager | 4/246.1 |

FOREIGN PATENT DOCUMENTS

| | | | |
|---|---|---|---|
| 0072094 | 11/1893 | Fed. Rep. of Germany | 4/246.3 |
| 0054287 | 4/1911 | Switzerland | 4/246.4 |

*Primary Examiner*—Robert M. Fetsuga

[57] ABSTRACT

Disclosed is a device for opening and closing a toilet seat hingedly attached to a toilet, which device comprises an elongated flexible cable having one end attached to the underside or outer periphery of the toilet seat at a position removed from the hinge attachment and the other end attached to an electric motor at a location remote from the toilet seat, wherein the electric motor also has a break for holding the toilet seat slightly less than full vertical or open position so that when the break is released, the toilet seat may be lowered to its horizontal or closed position. In a further embodiment of the device disclosed is a spring on the hinge which urges a seat toward the horizontal or closed position and having its greater urging force when the seat is in the vertical or open position.

6 Claims, 2 Drawing Sheets

DEVICE FOR OPENING AND CLOSING TOILET SEAT

BACKGROUND OF THE INVENTION

1. Field of the Invention

This invention relates to a device for opening and closing a toilet seat, more particularly this invention relates to a device for opening and closing a toilet seat in a sanitary manner and even more particularly this invention relates to a manually operated and motorized device for opening and closing a toilet seat in a versatile, simple and sanitary manner.

2. Description of the Prior Art

Various devices have been disclosed to facilitate lifting and closing toilet seats and lids, thereby eliminating human contact with unsanitary surfaces, expecially the underside surface of the seat. Some of these devices reduce or eliminate the need to bend over to lift the seat. Such devices as special handles connected to the outer periphery of the toilet seat, foot operated mechanical means, automatic lowering mechanisms and motorized lifting mechanisms with a time interval before closing, have been disclosed. It is always preferred that these devices can be inexpensively and easily installed on an existing toilet, easily cleaned, easily operated and usefully practical in both public and private restrooms.

For example, U.S. Pat. No. 4,979,238 to Clark discloses a combination toilet seat lifter and toilet flusher which comprises a handle that fits the flush handle and fits the side of the toilet seat.

U.S. Pat. No. 4,995,120 to Tager discloses a toilet seat closing device which comprises a DC motor in connection with a clutch mechanism that also includes a control circuit and a timer.

U.S. Pat. No. 4,807,307 to Sato et al. discloses a device for opening and closing a toilet seat by use of foot petals which operates a mechanism that lifts and/or closes the seat and/or lid.

U.S. Pat. No. 4,951,324 to Lirette discloses a knee operated handle attached to the outside periphery of the toilet seat and which places another handle in position to be easily reached by hand to lift the seat.

U.S. Pat. No. 4,805,246 to DeVargas et al. discloses a toilet seat handle with a provision for a deodorant cake where a sanitary cover or sleeve is provided for the handle.

U.S. Pat. No. 4,920,586 to Giallourakis discloses a seat handle attachment which handle consist of a ring of small surface area that can be contaminated.

U.S. Pat. No. 4,850,062 to Gibson et al. discloses a disc shaped toilet seat lifting aid which round edge and pivital mount present little danger of abrasion to a user's leg.

U.S. Pat. No. 4,875,251 to Hazard discloses a device for attachment to a toilet seat as an aid to raising or lowering the seat wherein the device comprises a base and a handle.

U.S. Pat. No. 4,843,656 to Forman discloses a toilet seat handle of unitary construction leaving no creases or crevises for nesting of germs or breeding of bacteria.

Even though some of these devices provide a handle that extends horizontally from the periphery of the seat, these handles are nonetheless in the area of contamination by germs and bacteria. Further, some of these devices require bending over to lift the seat. Foot operated devices require great exertion in order to effect the lifting of the seat. The motorized devices do not provide an inexpensive, easy or smooth operation.

It is therefore an object of the present invention to provide a toilet seat opening and closing device which does not require touching on or near contaminated surfaces. It is a further object of the present invention to provide a device which does not require bending over and lifting. It is an even further object of the present invention to provide a device which operates smoothly and quietly. It is an even further object of the present invention to provide a motorized powered device for raising and lowering the toilet seat.

SUMMARY OF THE INVENTION

Accordingly, applicant has discovered a novel device for opening and closing a toilet seat hingedly connected with the toilet, which device overcomes the problems of the prior art. Disclosed is a device comprising an elongated flexible means having one end attached to the underside or outer periphery of the toilet seat and the other end attached to a pulling means which pulls the toilet seat to an open or substantially vertical position. The pulling means has a holding means to hold the toilet seat in the open position. To close the toilet seat, the holding means is released, thereby allowing the pulling means to lower the seat back to its horizontal or closed position. The pulling means may be manual or powered.

Another embodiment of applicants invention includes an urging means which urges the seat towards the closed or horizontal position. The urging means has it greater urging force when the seat is in the vertical or open position. The holding means associated with the pulling means holds an open or substantially vertical seat against the force of the urging means. When the holding means is released, the urging means urges the seat toward the horizontal or closed position as the pulling means lowers the seat back to its horizontal or closed position.

BRIEF DESCRIPTION OF THE DRAWINGS

A better understanding of the invention will be had upon reference to the following description in conjunction with the accompanying drawings wherein.

DESCRIPTION OF THE PREFERRED EMBODIMENT

Figure 2:
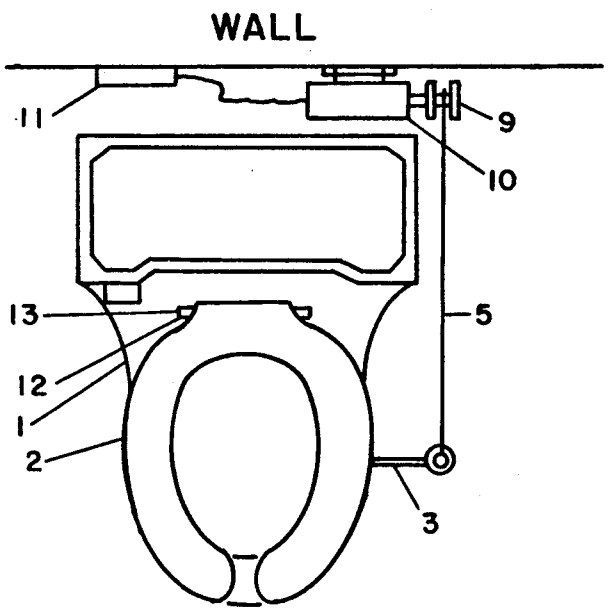
FIG. 2 is a top or plan view of a conventional toilet illustrating an embodiment of the motorized power device for raising and lowering the toilet seat.

According to applicant's invention a device for opening and closing a toilet seat hingedly attached to a toilet is disclosed. The device comprises an elongated flexible means having one end attached to the underside or outer periphery of the toilet seat at a point removed from the hinged attachment. This elongated flexible means may be a chain, rope, wire, cable, string, links or such like. It may be attached to the underside or outer periphery of the toilet seat with an adhesive, screw, latch, catch or other similar means. This attachment may be extended horizontally and outwardly from the toilet seat to provide room for wide persons. This may be facilitated by a rigid or simi-rigid piece of suitable material having one end attached to the underside or outer periphery of the seat and the other end attached to the elongated flexible means.

The other end of the elongated flexible means is attached to a pulling means mounted at a location remote from the unsanitary elements of the seat. As the pulling means pulls the elongated flexible means, the toilet seat raises from the horizontal or closed position to an open or vertical position. Most toilet seats will stay in its fully open position because it rotates on its hinges past vertical to rest on the water closet or on a stop on its hinges. It is preferred that in the present invention that the toilet seat is raised to slightly less than vertical so that a release of the seat will allow the pulling means to slowly lower the seat with the aid of gravity to its horizontal or closed position.

However, in another embodiment of the invention, an urging means is provided so that when the toilet seat is raised past its vertical or open position, the urging means will cause the seat to move back to the other side of vertical so that the seat can be lowered to rest at its horizontal or closed position with the aid of gravity. The urging means may also be such that it will urge the seat for the duration of its travel to its rest at its horizontal or closed position. An example of an urging means would be a torsion spring on the hinge between the toilet seat and the toilet stool, wherein the force of the torsion spring on the hinge would urge the seat toward the closed position on the toilet stool. Such springs on hinges are well known in the art and can be applied to toilet seat hinges.

The pulling means may be manual or powered. In the case of the manual pulling means, the elongated flexible means is manually pulled through a restriction means until the seat is slightly less than full vertical position. When the seat reaches this position, it is held in place by a holding means. When it is desired that the seat be lowered, the holding means is released and the seat is slowly lowered to its horizontal or closed position. An example of a manual pulling means and a restriction means is simply a handle (pulling means) on the end of the elongated flexible means which is pulled through a piece of tubing (restriction means) mounted at a locaton remote from the toilet seat. The handle could have endentations (holding means) which catches on the end of the tubing to hold the seat in the vertical or open position.

In the case of the powered means, the powered means, mounted at a location remote from the toilet seat, similarly pulls the elongated flexible means and raises the seat until the seat is slightly less that vertical and holds the seat at that position by a holding means such as a braking device in the powered means. To lower the seat, the powered means is made to release its hold on the elongated flexible means and is reversed to lower the seat to its horizontal or closed position. The urging means may be used similarly with the powered means as with the manual means. The powered means can be an electric motor having a shaft fitted with a pulley which reels the elongated flexible means thereon. The internal friction within the motor may be sufficient brakes to hold the seat against the urging force or against the pull of gravity upon the seat. If this internal friction is not sufficient, these electric motors can be especially equipped with brakes which holds its shaft when the motor is not running. Such electric motors are well known in the art.

The pulling means may be mounted on the water closet of the toilet, on the wall behind the toilet or on a wall or fixture such as a vanity on the side of the toilet. The position of the pulling means may be facilited by pulleys or idlers which guide the elongated flexible means such that the best angle may be obtained relative to the seat to minimize the force necessary to lift the seat and so that the elongated flexible means is out of the way when the toilet is in use.

Figure 1:
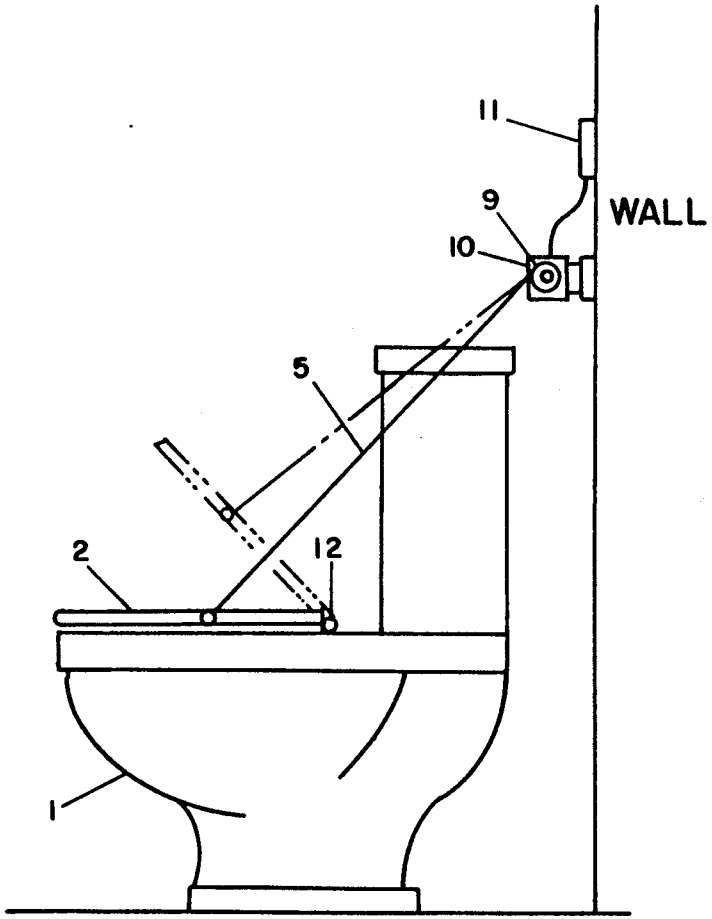
FIG. 1 is a side elevational view of a conventional toilet illustrating an embodiment of the motorized power device for raising and lowering the toilet seat.

Reference is now made to FIGS. 1 and 2 which shows an embodiment of applicant's invention which utilizes the motorized powered pulling means. Toilet 1 has a toilet seat 2. Rope 5 is attached to seat 2 with extension 3 which provides seating room. Rope 5 is attached to a small diameter pulley 9 on reversible electric motor 10. Switch 11 is in electrical connection with a power source and motor 10 so that switch 11 can energize the motor to turn in reversing directions. When seat 2 is in the horizontal or closed position, switch 11 is energized to supply power to motor 10 which turns pulley 9 in the direction which reels thereon rope 5 to pull seat 2 upwardly. When seat 2 reaches slightly less than full vertical position, switch 11 is turned off. Because of the small diameter of pulley 9, the internal friction in motor 10 has sufficient brakes so that seat 2 is held in this position. To close seat 2, switch 11 is energized to supply power so that electrical motor 10 rotates pulley 9 in reverse, thereby lowering seat 2 to the horizontal or closed position.

Figure 3:
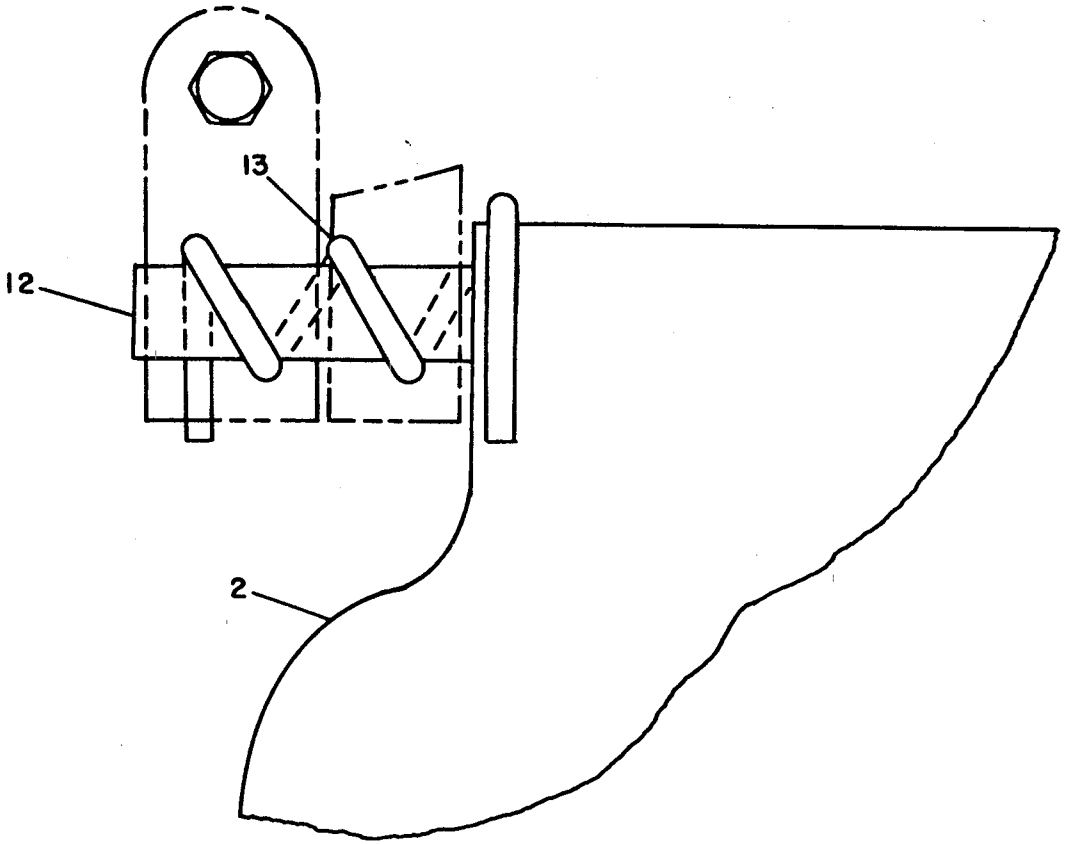
FIG. 3 is an enlarged view of the toilet seat hinge illustrating the spring as an urging means.

Hinge 12 is equipped with a torsion spring 13 (see FIG. 3) which urges seat 2 toward its closed position, seat 2 may be raised to the fully open position. As motor 10 unreels rope 5, the torsion spring 13 on hinge 12 urges seat 2 past vertical and along with the pull of gravity urges seat 2 toward the horizontal or closed position.

While specific embodiments of the present invention are described, it is not intended that those specific embodiments limit applicant's inventive concept. Various modifications are anticipated without departure from applicant's inventive intent.

I claim:

1. A device for opening and closing a toilet seat hingedly attached to a toilet comprising an elongated flexible means having on one end of the elongated flexible means a means for attachment to extend from the outer periphery of the toilet seat at a point removed from the hinge attachment and having attached to the other end of the elongated flexible means a pulley adapted to be located at a position remote from the toilet seat and capable of acting as a reel, wherein said pulley is mounted on the shaft of a reversing electric motor and said motor is controlled by a switch which operates the motor in reversing directions, wherein the motor has a holding means for holding the seat after the seat is raised from a horizontal or closed position to less than full vertical or open position and wherein the holding means can be released so that the motor can lower the seat back to the horizontal or closed position.

2. The device of claim 1, wherein the elongated flexible means is taken from the group consisting of a rope, chain, cable, string or links.

3. The device of claim 1 which further comprises an urging means which urges the seat toward the horizontal or closed position.

4. The device of claim 1 which further comprises a torsion spring which urges the seat toward the horizontal or closed position.

5. A device for opening and closing a toilet seat hingedly attached to a toilet comprising a rope having on one end of the rope a means for attachment to extend from the outer periphery of the toilet seat at a point removed from the hinge attachment and on the other end of the rope a pulley mounted on the shaft of an electric motor adapted to be located at a position remote from the toilet seat, wherein said motor is controlled by a switch electrically connected with the motor and a power source in a manner to operate the motor in reversing rotational directions, wherein as the pulley rotates it reels the rope thereon causing the seat to be raised, wherein the electric motor has internal friction for holding the raised seat in a substantially vertical or open position, and wherein the friction is overcome when the motor is operated in reverse so that the electric motor unreels the rope to lower the seat back to the horizontal or closed position.

6. The device of claim 5, wherein it further comprises a torsion spring on said hinge such that said torsion spring urges said seat toward the horizontal or closed position.

* * * * *